US005499022A

United States Patent [19]

Boschini

[11] Patent Number: 5,499,022

[45] Date of Patent: Mar. 12, 1996

[54] REMOTE CONTROL SYSTEM FOR LOCKING AND UNLOCKING DOORS AND OTHER OPENINGS IN A PASSENGER SPACE, IN PARTICULAR IN A MOTOR VEHICLE

[75] Inventor: Alain Boschini, Nanterre, France

[73] Assignee: Valeo Electronique, Creteil, France

[21] Appl. No.: 147,944

[22] Filed: Nov. 4, 1993

[30] Foreign Application Priority Data

Nov. 6, 1992 [FR] France ..... 92 13421

[51] Int. Cl.[6] ..... G08C 19/00

[52] U.S. Cl. ..... 340/825.69; 340/825.31

[58] Field of Search ..... 307/10.8; 180/281; 340/825.69, 825.31, 825.32, 825.54

[56] References Cited

U.S. PATENT DOCUMENTS 5,113,182 5/1992 Suman et al. ..... 340/825.32
5,157,389 10/1992 Kourozu ..... 340/825.32

FOREIGN PATENT DOCUMENTS 140137 5/1985 European Pat. Off. .
0158354 10/1985 European Pat. Off. .
426114 5/1991 European Pat. Off. .
2589186 4/1987 France .

OTHER PUBLICATIONS

IEEE Transaction on Industrial Elecronics and Central Instrumentation, vol. 35, No. 2, May 1, 1988, New York U.S. pp. 208–216 Motoki Hirano et al., "Keyless Entry System with Radio Card Transponder".

*Primary Examiner*—Michael Horabik
*Attorney, Agent, or Firm*—Morgan & Finnegan

[57] ABSTRACT

A remote control system for locking and unlocking a passenger space in a motor vehicle has an on-board unit that includes an emitter of signals $S_E$ of a first type and receiver of signals $S_P$ of a second type. There also is a portable device that has a receiver of first type signals $S_E$ and an emitter of second type signals $S_P$. The apparatus also detects that the portable device has been forgotten inside the passenger space by determining the relative position of the portable device in relation to the interior of the passenger space. The apparatus for determining the position of the portable device in relation to the interior of the passenger space is integrated into the portable device with the portable device emitter of the second type signal $S_{pforgotten}$ in the event of detection of the portable device having been forgotten inside the passenger space.

7 Claims, 4 Drawing Sheets

REMOTE CONTROL SYSTEM FOR LOCKING AND UNLOCKING DOORS AND OTHER OPENINGS IN A PASSENGER SPACE, IN PARTICULAR IN A MOTOR VEHICLE

FIELD OF THE INVENTION

The present invention relates to a remote-control system for locking and unlocking doors and openings in a passenger space, in particular in a motor vehicle. The purpose of such a system is to ensure locking or unlocking without the use of a mechanical key, nor any device requiring manual intervention on the part of the user. Each of the authorised drivers has a portable device, for example in the form of a badge, ensuring communication with an on-board unit when the person carrying the device approaches the vehicle.

The invention more precisely relates to such a system integrating a function for recognising that an on-board device has been forgotten inside the passenger space. This situation can arise for example when the driver leaves a garment, in the pocket of which he has put the portable device, or when a second authorised driver has been seated in the passenger space as a passenger, and remains in the vehicle, or leaves his garment in the passenger space after the driver has got out. It is essential that the locking and unlocking system controls these situations to avoid the driver having to perform an inadvertent locking, the device remaining locked inside the vehicle, or an inadvertent unlocking, where the vehicle no longer offers any anti-theft security.

BACKGROUND OF THE INVENTION

A first solution to meet this objective in known in the prior art. European patent EP 140137 describes a system comprising an on-board emitter-receiver unit and a portable emitter-receiver unit. This document describes a solution for recognising the situation in which the badge has been forgotten in the vehicle, by measuring over a determined period the level of the signal received by the on-board receiver, and emitted by the portable device. When the signal variations inside a given period of time are less than a predetermined value, the on-board system produces an alarm signal.

This solution is not entirely satisfactory, as it involves the emission of a signal by the emitter of the on-board device over a relatively long period, of several seconds. As a result there is a significant energy consumption, and this involves the use of a powerful source of electrical energy which is at odds with the aim of miniaturisation and weight reduction. Furthermore, such a solution is highly dependent on the stability of the emission level and may be disturbed by the variations caused by drops in the supply voltage e.g. when the batteries of the portable device are worn out.

Finally, in the case in which several badges remain in the power range, each badge has to be controlled sequentially, which greatly complicates the system.

A second solution is described in European Patent Application EP 426114, which also consists of determining the position of a portable device in the form of a card by means of a detector integrated in the on-board system. The determination of the position is performed not by measuring the variation of the level, but by the use of several antennae installed at various points of the vehicle, and enabling the origin of the emission to be determined, and therefore the position of the card with respect to the interior of the vehicle.

This solution also involves the quasi-continuous emission of a signal from the portable emitter, and therefore has substantially the same drawbacks as the first solution.

The object of the present invention is to propose a system which detects that the portable device has been forgotten, without recourse to a prolonged emission from the portable device, in order to reduce consumption, and to avoid disturbances caused by variations in the supply voltage. Furthermore, a system according to the invention is compatible with a supply of the portable device by induction.

SUMMARY OF THE INVENTION

For this purpose, the system according to the invention comprises:

an on-board unit comprising an emitter of signals $S_E$ of a first type and a receiver of signals $S_P$ of a second type;

a portable device comprising a receiver of first type signals $S_E$ and an emitter of second type signals $S_P$; and means for detecting that a portable device has been forgotten inside the passenger space by the determination of the relative position of the portable device in relation to the interior of the passenger space. In order to meet the objectives of the invention, the means for determining the position of the portable device in relation to the interior of the passenger space are integrated in the portable device, the said means generating a signal controlling the emission by the emitter of the portable device of a second type signal $S_{pforgotten}$ in the event of the detection of the portable device having been left inside the passenger space.

The portable device therefore only emits a signal for a very brief period of time, after the vehicle has stopped, and essentially in the case in which the portable device has been forgotten inside the passenger space, which a priori is an exceptional situation.

In the following, the system is set forth in relation to the locking and unlocking of a vehicle, but it is understood that the same system could be used for other applications, for example in the field of domestic security or of inspection of access in protected sites.

According to a preferred embodiment, the system according to the invention comprises a plurality of customised portable devices, each of said portable devices emitting a second type signal $S_{Pi}$ comprising a sequence for the identification of the on-board device in question, in the case when detection indicates that it has been forgotten inside the passenger space. This embodiment enables a particular device to be identified, in the case in which several drivers are each equipped with a customised device, and the forgotten portable device to be temporarily deactivated, whilst enabling the use of other devices.

According to a first refinement, the on-board device emits a first signal $S_{E1}$ before the doors are locked, and also a second signal $S_{Ever}$ after the doors have been locked. The portable device comprises a memory circuit for recording level $M_1$ of the first signal $S_{E1}$ and level $M_2$ of the second signal $S_{Ever}$ detected by the receiver, and a computer for generating a signal for activating the emission sequence of second type signals $S_{Pforgotten}$ corresponding to the detection of the forgotten portable device, in the case in which the difference between the two memorised levels $M_1$, $M_2$ is less than a predetermined value m.

The on-board unit advantageously also emits a third signal $S_{Etemp}$ at the end of a predetermined period of time after the emission of the second signal $S_{Ever}$, the portable device memorising level $M_3$ of the said third signal $S_{Etemp}$ detected. The computer of the portable device also controls the emission of a signal $S_{Pforgoten}$ of the second type corresponding to the detection of a forgotten device in the case in which the difference between level $M_2$ of the second and level $M_3$ of the third signals memorised is less than a predetermined value M'.

According to a second refinement, the on-board unit comprises means for the emission of signals, in a selective manner by an interior antenna, placed inside the passenger space, and the radiation lobes of which are mainly confined inside the passenger space, by an external antenna disposed close to the driver's door and the emission lobes of which are mainly confined outside the vehicle, and by a second external antenna disposed close to the door opposite the driver's door and the emission lobes of which are mainly confined outside the vehicle, the portable device emitting a signal $S_{Pforgotten}$ corresponding to the detection of the forgotten device in the case in which the receiver does not detect any signals $S_{Eextd}$ after the reception of a first type signal $S_{Ever}$ corresponding to the information "doors locked".

According to a particular method according to the invention, of use of this second refinement, the on-board unit also emits first type signals $S_{E1}$ at the moment of the operation of the door handle, and in that the portable device emits a second type signal $S_{Pforgotten}$ corresponding to the portable device being forgotten when the signal $S_E$ detected at the moment of the reception of said signal of the operation the handle corresponds to the signal $S_{Eint}$ emitted by the internal antenna.

The on-board unit advantageously comprises means for emitting signals $S_{E1ext}$ and $S_{E1int}$ at the moment when the driver's door is shut, the signal $S_{E1int}$ transmitted by the internal antenna comprising a specific coding, means for emission by the internal antenna of a second series of signals corresponding to the locking of the passenger space, means for emitting, after a predetermined period of time, by the external antenna provided on the driver's side a third series of signals, and means for emitting subsequently, by the external antenna provided on the side opposite to the driver's side, a fourth series of signals, and in that the portable device comprises means for generating a signal $S_{Pforgotten}$ in response to the reception of the coded signal $S_{E1int}$, as well as an identification signal in response to the reception of a non-coded signal $S_E$.

According to a preferred method according to the invention, the on-board unit comprises means to interrupt the verification process when the on-board receiver receives an identification signal $S_{Pidentif}$, in response to the emission of the signal emitted at the moment the door is shut.

The invention will be better understood by reading the following description given by way of example with reference to the attached drawings:

DETAILED DESCRIPTION OF THE PREFERRED EMBODIMENTS

Figure 1:
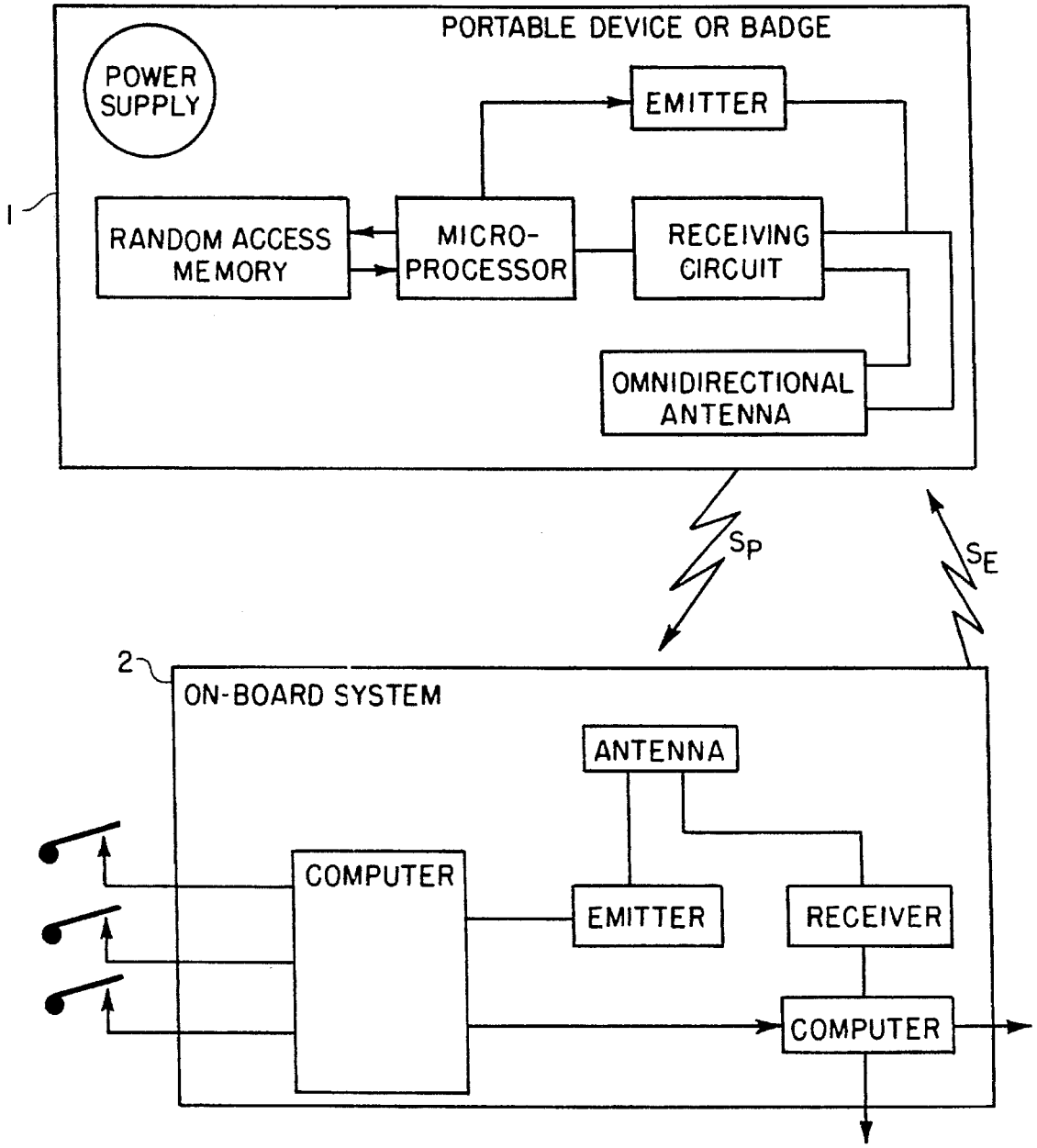
FIG. 1 represents the skeleton diagram of a system according to the invention.

FIG. 1 represents the skeleton diagram of a non-restrictive embodiment of the invention.

The system principally comprises two subsystems, a portable device 1 in the form of a badge and an on-board system 2 installed in the vehicle.

The badge 1, a term which will be used in the following description to designate the portable device, comprises a power supply 3, for example a lithium battery. It furthermore comprises an omni-directional antenna 4, for the emission and reception of radio-frequency signals. A receiving circuit 5 of a known type is connected to a microprocessor circuit 6 which is capable of sampling the level of the signal detected by the receiver, and of recognising the different types of signals received.

The microprocessor circuit 6 is connected to a random access memory 7 capable of memorising the numerical information relative to the level of the signal received by the receiver 5. The microprocessor circuit 6 also controls the emitter 8.

The on-board unit 2 also comprises one or more antennae 11, housed in the passenger space or outside the vehicle. An emitter 12 generates a coded signal $S_E$ for the transmission of information relating to the state of the vehicle. This information originates from a computer 13 receiving signals coming from different contacts detecting the open or closed state of the doors of the vehicle, the position of the locking means, the action of the door handles, and generally any useful information regarding the state of the different parts of the vehicle. This information is preferably transmitted by means of a series connection BUS.

The on-board unit furthermore comprises a receiver 14 supplying signals to a computer 15 commanding the locking members, the starter control members, the sound or visual alarm systems and possibly the motorised adjustments of the different parts of the vehicle requiring a particular adaption to each referenced driver, for example the adjustments to the driving mirrors, to the driver's seat or the height of the steering wheel.

Figure 2:
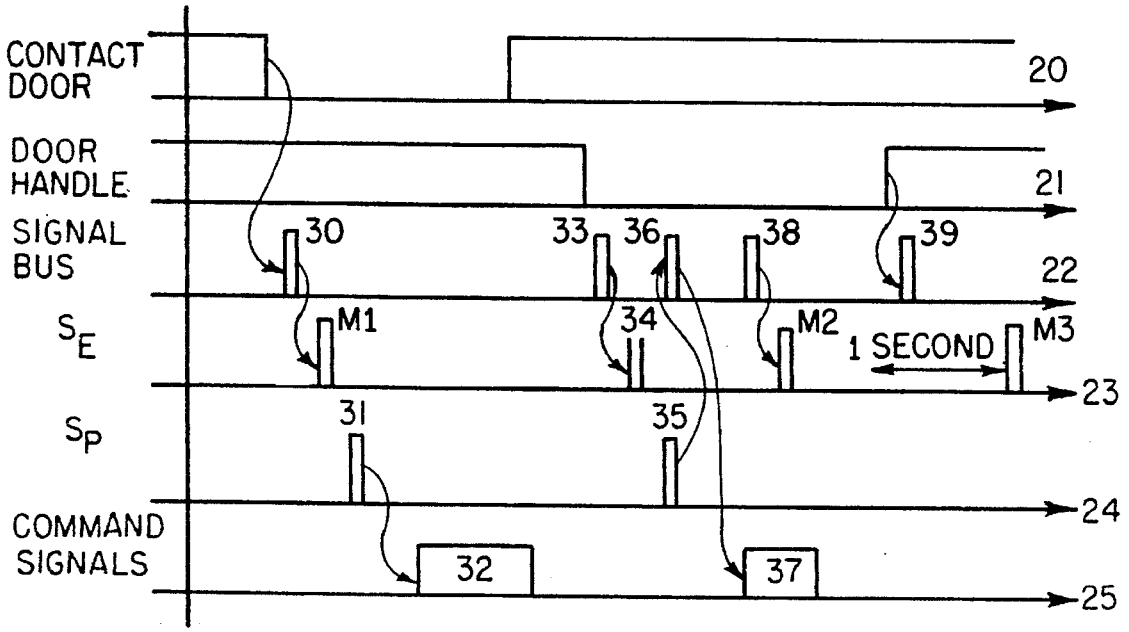
FIG. 2 represents the timing diagram of the system according to a first embodiment, in a normal situation.

FIG. 2 represents the timing diagram of the exchanges of signals between the badge 1 and the on-board unit 2 in a so-called normal situation, in which the driver leaves his vehicle without forgetting his badge, and without any passenger forgetting a badge inside the vehicle.

The detection of the forgotten badge in the vehicle after the doors have been locked is based on the measurement of the level of the signal $S_E$ received by the receiver at different instants, before and after locking. These instants are chosen at moments when the driver, who normally carries the badge, is a priori at different distances from the emission antenna of the on-board unit. When the level of the signal $S_E$ measured over several consecutive messages by the computer 6 connected to the receiver 5 of the badge remains substantially constant, the badge may be regarded as remaining in the passenger space, and it is necessary in this case to alert the driver. On the other hand, if the measured level is different, it is considered that the badge has changed position and has moved away from the passenger space with the driver. The locking process may then take place normally. In this first refinement, the signal $S_E$ is transmitted by an interior antenna.

Figure 3:
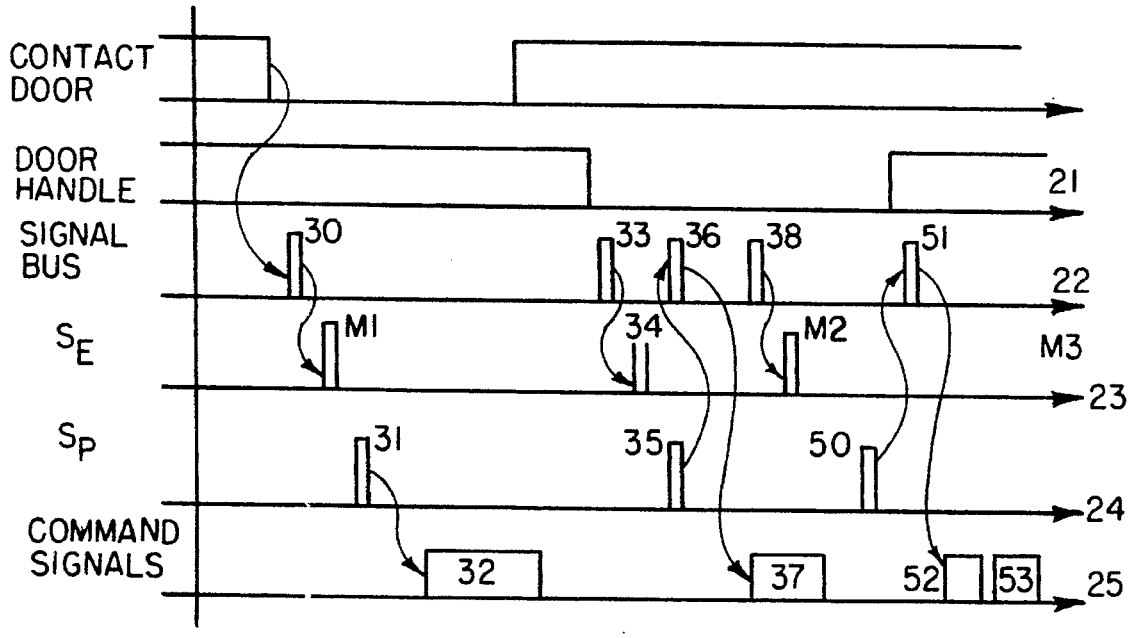
FIG. 3 represents the timing diagram of the system according to the same embodiment, in a situation in which the portable device has been left inside the vehicle.

The timing diagram which is shown in FIGS. 2 and 3 represents different electrical signals:

signal 20 represents the signal detected on the opening contact of the driver's door;

signal 21 corresponds to the signal detected on a sensor, a micro contactor or an optical detector provided on the driver's door handle;

signal 22 represents the envelope of the coded messages circulating on the interconnection BUS of the on-board unit 2 with the different sensors equipping the vehicle;

signal 23 represents the envelope of the emission sequences $S_E$ emitted by the emitter of the on-board unit 2;

signal 24 represents the envelope of the emission sequences $S_P$ emitted by the emitter of the badge 1;

signal 25 represents the command signals of the locking and security organs of the vehicle.

When the driver's door is opened, the signal 20 coming from a contactor changes state, and triggers the emission of a coded message 30 on the BUS 22. The computer 13 of the on-board unit 2 brings about the emission of a signal $S_E$ detected by the receiver 5 of the badge 1. The computer 6 of the badge 1 samples the signal received and records in the EEPROM memory 7 information $M_1$ corresponding to the level of the signal received. Furthermore, it triggers the emission of a coded pulse 31 $S_p$ comprising an identification sequence of the badge in question. For this purpose, each badge comprises in a random access memory or in a read-only memory a single specific code capable of identifying the badge, and consequently the person to whom the badge is attributed.

On the receipt of the signal 31 by the receiver 14 of the on-board unit 2, the computer 15 controls the locking of the starter control member.

When pressure is applied to the handle of the driver's door, the signal 21 coming from a micro-sensor changes state and triggers the emission of a coded message 33 on the interconnection BUS. The computer 15 controls in return the emission of an identification request signal 34. On receipt of this signal, the badge 1 emits an identification signal 35.

The reception of this identification signal 35 causes the transmission on the BUS of a coded message 36 controlling the locking 3 of the doors.

When the locking of the doors has been carried out, the sensors detecting the locking trigger on the BUS a coded message activating the emission of a signal $S_E$ 38. This signal is detected by the receiver 5 of the badge 1 and its level is digitised. This level is stored in the memory 7 in the form of information $M_2$.

The two levels $M_1$ and $M_2$ are then compared. In the example represented in FIG. 2, the levels $M_1$ and $M_2$ are different, and the computer 6 of the badge 1 does not control any emission $S_p$.

After a predetermined period of roughly one second following the receipt of the coded message 39 corresponding to the release of the door handle, the on-board emitter emits a signal giving rise to the detection of the badge 1 of a level $M_3$. In the example shown in FIG. 2 corresponding to a normal situation, level $M_3$ is different from $M_2$, and consequently the emitter 8 of the badge 1 remains inactive.

FIG. 3 represents the situation in which a badge has been forgotten inside the vehicle.

The difference between levels $M_2$ and $M_1$ is in this case less than a predetermined threshold value, and consequently the computer 6 of the badge 1 controls the emission of a signal $S_{P.forgotten}$ 50. This signal is detected by the receiver 14 of the on-board unit 2, and the computer transmits on the BUS a coded message 51 bringing about unlocking 52 and the activation of a sound alarm signal 53.

In the case in which several people each have a customised badge, and forget their badge in the vehicle, and the driver has left the vehicle without forgetting his badge, the on-board computer 15 deactivates the codes identifying the forgotten badges until the following unlocking operation.

Figure 4:
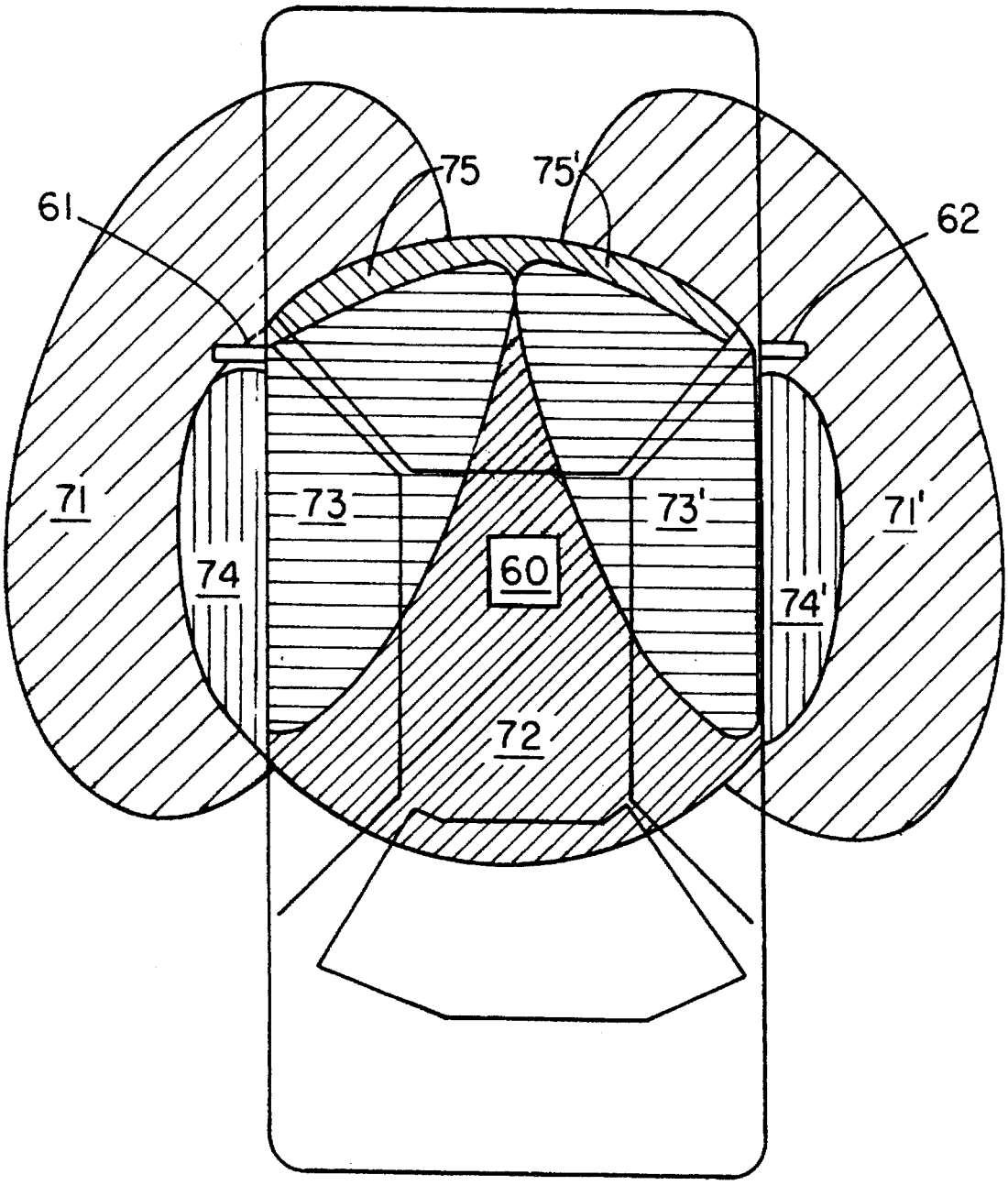
FIG. 4 represents the radiation diagram of the antennae used in the system according to a second embodiment.

FIG. 4 represents a diagrammatical view of a vehicle equipped with a system according to a second embodiment.

This refinement has the advantage of allowing the instantaneous prohibition of the locking of the doors when the badge has been forgotten inside the passenger space (zones 73 and 73'), whereas with the detection by measuring the level variation, the relatively great measurement time (in the order of several seconds) involves an locking-unlocking sequence of the doors if a forgotten badge is detected inside the passenger space.

The emission lobes of the internal antenna 60, of the external antenna 61 placed on the driver's side, and of the external antenna 62 place on the opposite side are shown by hatched surfaces. The external antennae 61, 62 are for example disposed in the exterior rear view mirrors.

In the zone 71, only the signals $S_{Eextg}$ coming from the external antenna 61 on the driver's side are received. When the badge is located in this zone, it is advisable to authorise the locking of the doors after the identification of the badge.

In the zone 71', only the signals $S_{Eextd}$ coming from the external antenna 62 on the passenger's side are received. When the badge is located in this zone, it is advisable to authorise the locking of the doors after the identification of the badge.

In the zone 72, the signals received by the badge come only from the internal antenna 60. In this case, it is advisable to trigger an alarm signal, and to prevent the locking of the doors if the doors have not yet been locked, or, if the doors have already been locked, to unlock them.

The zones 73 and 73' correspond to zones inside the vehicle in which the badge receives signals coming from both the internal antenna 60 and one of the external antenna 61 and 62 respectively.

In this case, it is advisable to trigger an alarm signal, and to prevent the locking of the doors if the doors have not yet been locked, or, if the doors have already been locked, to unlock them.

The zones 74 and 74' correspond to zones outside the vehicle in which the badge receives signals coming both from the internal antenna 60 and one of the external antennae, 61 and 62 respectively. When the badge is located in this zone, it is advisable to permit the locking of the doors after the identification of the badge.

Figure 5:
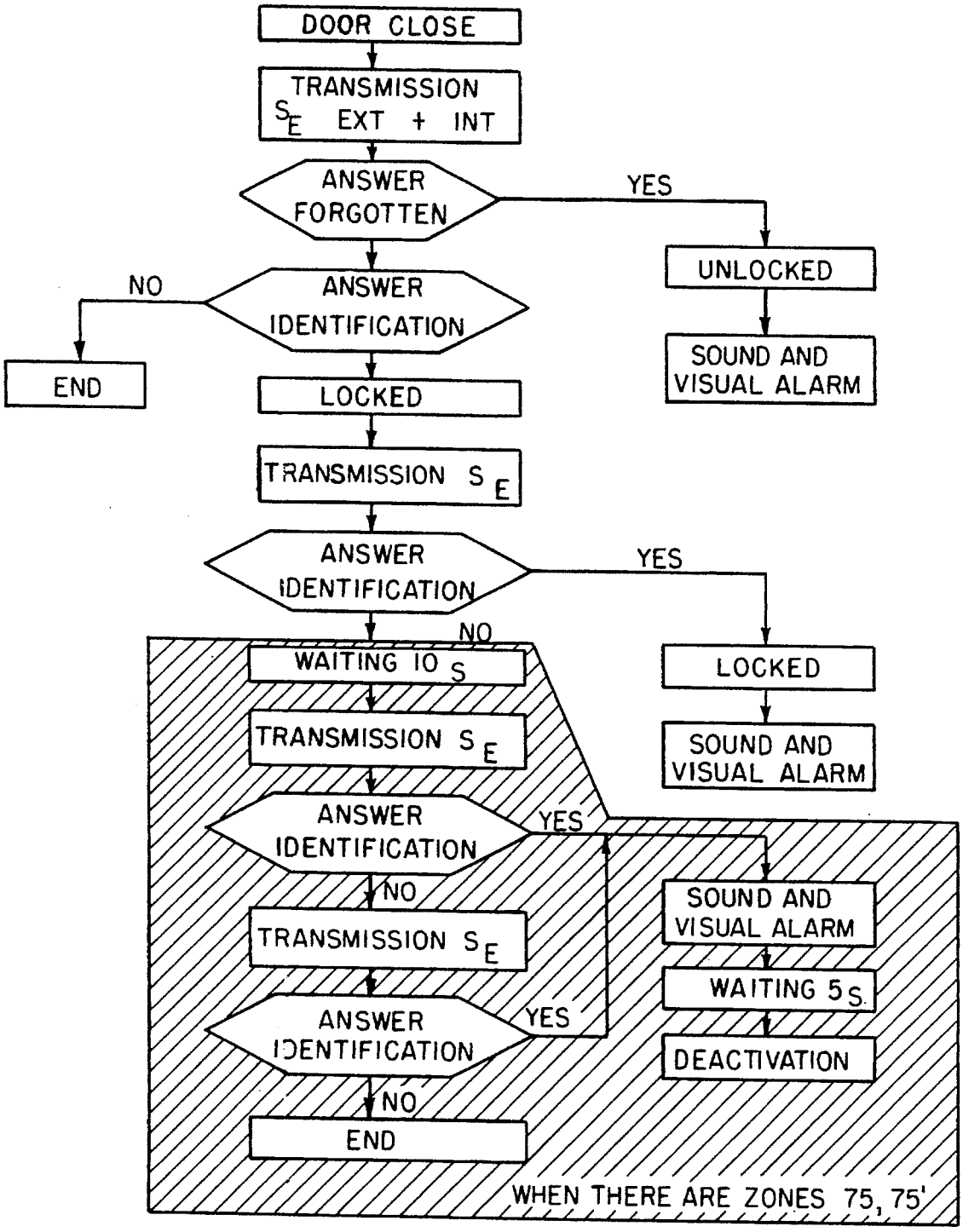
FIG. 5 represents the flow chart of the procedure used in a system according to the second embodiment.

FIG. 5 represents the flow chart of the procedure for detecting that the badge has been forgotten, according to this second refinement, using antennae as represented in FIG. 4.

The badge comprises a receiver and a computer triggering the emission of an identification signal comprising a code particular to the badge in question in reply to a signal coming from the on-board emitter, or the emission of a signal corresponding to the situation in which the badge is forgotten if the signal coming from the on-board emitter comprising a specific coding sequence, and regardless of the antenna excited by the on-board emitter. If the badge detects specific coded sequences transmitted by the internal antenna 60, it responds that it has been forgotten by a signal $S_{forgotten}$.

At the moment when pressure is exerted on the door handle, the on-board emitter emits, by the intermediary of the internal antenna, a signal $S_{Eint}$ comprising a specific sequence as well as a coded signal $S_{Eext}$ by means of external antennae 61, 62. If the badge is located in the internal zone 73, its receiver receives the signal $S_{Eint}$ comprising the specific sequence identifying the internal antenna 60 and also the signal $S_{ext}$ of the external antenna 61, and the computer of the badge in return controls the emission of a signal comprising coded information corresponding to the badge having been forgotten inside the vehicle. In this case, the on-board computer prevents the locking of the doors and activates a sound or visual alarm signal.

Should the badge be located in zone 71 or 71', where it only receives the signal $S_{Eext}$ coming from one of the external antennae 61, 62, the computer controls the emission of a signal comprising an identification sequence for the badge, and in response, the on-board computer controls the locking of the doors, then controls the emission of a new signal $S_{Eint}$ by the internal antenna 60, without a specific code. If the badge responds by an identification signal, it is considered as having remained inside the vehicle and the on-board computer brings about the unlocking of the doors, and the triggering of a sound or visual alarm.

Should the badge be located in one of zones 75, 75', and the configuration of the lobes of the antennae 60, 61, 62 results in the existence of such zones, the on-board computer controls the emission of a signal $S_{Eextg}$ without a specific sequence, roughly 10 seconds after the locking of the doors, by means of the external antenna on the driver's side 62 only. If the badge replies by an identification signal, the on-board computer triggers the sound or visual alarm. If the driver does not unlock the doors, the on-board computer deactivates the badge.

In the opposite case, the on-board computer controls the emission of another signal $S_{Eextd}$ without a specific sequence, by means of the external antenna 61 on the passenger side only.

If the badge responds by an identification signal, the on-board computer triggers the sound or visual alarm. The detection procedure is over.

The existence of a complementary sequence of identification requests 10 seconds after the locking of the doors, corresponding to stages included in the hatched zone of FIG. 5, in certain cases however result in the forgotten badge being wrongly detected, when the driver remains close to the door, with the badge being in his pocket, after the doors have been locked. These false detections, although ill-timed, do not however question the security of the system according to this refinement.

The zones 74, 74' are zones where the badge is rarely found. In the event of it being located there, this would simply result in a false detection without any impact on the security of the vehicle.

It will be clear that a person skilled in the art will be able to realise various refinements without departing from the scope of the invention. In particular, the nature of the signals is not limited to hertzian signals. Similarly, it is possible to use various solutions to detect the relative position of the badge in relation to the interior of the vehicle, or more generally of a passenger space, without departing from the scope of the invention.

What is claimed is:

1. A remote control system for locking and unlocking a passenger space, in particular in a motor vehicle, comprising an on-board unit for emitting signals $S_E$ including a first signal $S_{EI}$ for emission in response to an unlocked passanger space and a second signal $S_{Ever}$ for emission in response to a locked passenger space, said on-board unit having a receiver of signals $S_P$; a portable device having a receiver for said on-board unit first signal $S_{EI}$ and said on-board unit second signal $S_{Ever}$ and an emitter for said portable device for one of said $S_P$ signals, including a signal $S_{Pi}$ that identifies said specific portable device, said portable device having a memory for recording the level $M_1$ of said on-board unit first signal $S_{EI}$ and the level $M_2$ of said on-board unit first signal $S_{Ever}$ detected by said portable device receiver, said portable device having a computer for generating a signal for activating an emission sequence from said portable device signals $S_P$ said emission sequence being a second type signal $S_{pforgotten}$ corresponding to the detection of said portable device in which the difference between said two levels $M_1$, $M_2$ is less than a predetermined value M.

2. A remote control system for locking and unlocking a passenger space according to claim 1, wherein the on-board unit also emits a third signal $S_{Etemp}$ at the end of a predetermined period of time after the emission of the second signal $S_{Ever}$, the on-board device memorizing the level $M_3$ of the third signal $S_{Etemp}$ detected and the computer of the portable device controlling the emission of said second type signal $S_{pforgotten}$ corresponding to the detection of said portable device in the case in which the difference between level $M_2$ of the second and level $M_3$ of the third memorized signals is less than a predetermined value M'.

3. A remote control system for locking and unlocking a passenger space according to claim 1, further comprising at least a driver's door and a door opposite thereto, said on-board unit having further means for the emission of signals in a selective manner by an internal antenna placed inside the passenger space for propagating a signal $S_{Eint}$ that reflects operation of said door handle and the radiation lobes of said antenna being mainly confined inside the passenger space; an external antenna disposed close to said driver's door and the emission lobes of which are mainly confined outside the vehicle; and a second external antenna disposed close to said door opposite said driver's door for emitting a signal $S_{Eextd}$ in which the emission lobes are mainly confined outside the vehicle, said portable device emitting said signal $S_{pforgotten}$ corresponding to the detection of said portable device as said on-board unit receiver fails to detect any signals $S_{Eextd}$ after receiving at least one of said first type signal $S_{Ever}$ corresponding to locking the passenger space.

4. A remote control system for locking and unlocking a passenger space according to claim 3, further comprising a door handle for generating an operating signal, said on-board unit emitting said first type signals $S_{EI}$ at the moment said door handle is operated, and said portable device emitting said second type signal $S_{pforgotten}$ corresponding to said portable device being detected in response to said signals $S_E$ as said door handle operating signal corresponds to said signal $S_{Eint}$ propagated by said internal antenna.

5. A remote control system for locking and unlocking a passenger space according to claim 3, wherein said on-board unit further comprises means for emitting signals $S_{Elex}$ and $S_{Eint}$ in response to closing said driver's door, said signal $S_{Eint}$ being transmitted from said internal antenna with a specific coding; means for emitting from the internal antenna a second series of signals corresponding to locking the passenger space; means for propagating, after a predetermined delay, from said external antenna close to the driver's side a third series of signals; and means for propagating subsequently from said external antenna on the side opposite the driver's side a fourth series of signals; and wherein said portable device has further means for generating said signal $S_{pforgotten}$ in response to the reception of said specific coded signals $S_{Eint}$, and identification signal $S_{pidentif}$ in response to at least one of said signals $S_E$.

6. A remote control system for locking and unlocking a passenger space according to claim 5, wherein said on-board unit comprises means for interrupting the passenger space locking and for activating an alarm signal when said on-board unit receives said signal $S_{pforgotten}$ in response to the emission of said signal $S_{Eint}$; and means for unlocking the passenger space and for generating said alarm signal when said on-board receiver receives said identification signal $S_{pidentif}$ in response to at least one of said signals $S_E$.

7. A remote control system for locking and unlocking a passenger space according to claim 6, wherein said on-board unit comprises signal verification means for identifying at least one portable device, said on-board unit further having means for interrupting said verification means identification in response to said on-board receiver receiving at least one of said identification signal $S_{pidentif}$ in response to the further emission of at least one of said door closing $S_{elex}$ and $S_{Eint}$ signals.

* * * * *